United States Patent [19]

Van Baasbank et al.

[11] 3,974,757

[45] Aug. 17, 1976

[54] DOWN-DRAUGHT DEFLECTOR-DRAUGHT INTERRUPTER

[75] Inventors: Pieter Van Baasbank, Eelde; Hubertus A. Flendrig, Groningen; Hilbert De Vries, Hoogezand, all of Netherlands

[73] Assignee: N.V. Nederlandse Gasunie, Groningen, Netherlands

[22] Filed: Aug. 29, 1974

[21] Appl. No.: 501,604

[30] Foreign Application Priority Data

Aug. 31, 1973 Netherlands ..... 7311990
July 31, 1974 Netherlands ..... 7410280

[52] U.S. Cl. ..... 98/119; 98/79; 126/307 A

[51] Int. Cl.[2] ..... F23L 17/00

[58] Field of Search ..... 98/119, 79, 122; 126/307 A

[56] References Cited

UNITED STATES PATENTS 1,856,478 5/1932 Greenberg ..... 126/307 A

FOREIGN PATENTS OR APPLICATIONS 492,605 11/1925 Germany ..... 98/79
592,018 2/1931 Germany ..... 98/79
1,088 10/1911 United Kingdom ..... 98/79
23,921 2/1912 United Kingdom ..... 98/79
323,068 12/1929 United Kingdom ..... 98/119

*Primary Examiner*—William F. O'Dea
*Assistant Examiner*—Harold Joyce
*Attorney, Agent, or Firm*—Cushman, Darby & Cushman

[57] ABSTRACT

A down-draught deflector - draught interrupter is described having a tube of circular or rectangular cross-section, an internal baffle element for laterally deflecting down-draught gases and peripheral escape openings for such gases. The tube has a substantially constant diameter and is provided in one end portion (upstream end portion) with an annular combustion gas deflector for deflecting combustion gases towards the tube axis and defines a gas flow path which at the position of its smallest cross-section has a diameter of 0.3–0.9 times the internal diameter of the tube.

The baffle element occupies within the tube a position wholly or mainly downstream with respect to said position of smallest flow-path cross-section and has a dimension in a plane normal to the tube axis of 0.2–0.9 times the internal diameter of the tube. The apertures in the tube wall are located so as to be at least in part opposite the baffle element. Between the baffle element and the tube are disposed radial walls in positions such as to prevent air entering the tube through one aperture from flowing directly out of the tube via another aperture.

11 Claims, 5 Drawing Figures

DOWN-DRAUGHT DEFLECTOR-DRAUGHT INTERRUPTER

The invention relates to a down-draught deflector - draught interrupter suitable for use in the flue of a gas-fired appliance, and of a kind comprising a tube having an internal baffle element for laterally deflecting down-draught gases and at least one peripheral escape opening for such gases.

The function of a down-draught deflector - draught interrupter, hereinafter called "down-draught deflector" for short, is, on the one hand, to enable a gas-fired appliance to perform independently of the chimney draught and, on the other, to cause reverse flow gases to escape and thus to avoid extinguishing of the gas flames or mal-functioning of the appliance. Such reverse flow may occur due to down-draught or blockage of the flue pipe.

A number of down-draught deflectors are shown for example in Appendix N of the gas-installation instructions (Gasinstallatie Voorschriften): GAVO 1970, NEN 1078. Such down-draught deflectors have a widened portion leading to an escape aperture and a baffle may be provided in the widened portion for deflecting down-draught to the aperture. Such deflectors are unsatisfactory for aesthetic reasons and/or due to their size.

Down-draught deflectors are also known which comprise a tube of more or less constant diameter and incorporate a helical assembly and a number of guide vanes for deflecting down-draught through apertures in the wall of the tube. These deflectors are relatively long, which is not desirable in all cases, and they are rather complex and expensive.

The purpose of the present invention is to provide a down-draught deflector of simple construction and which can be relatively short.

The present invention; as broadly defined, resides in a down-draught deflector of the kind referred to in the first paragraph of this specification, characterised in that the deflector has the following combination of features:

a. said tube has a substantially constant external diameter;

b. an annular combustion gas deflector is present in one end portion (hereafter called "upstream end portion") of the tube for deflecting combustion gases inwardly towards the tube axis, said combustion gas deflector defining a gas flow path which at the position of its smallest cross-section has a diameter of 0.3–0.9 times the internal diameter of the tube;

c. the baffle element occupies within the tube a position wholly or mainly downstream with respect to said position of smallest flow-path cross-section;

d. the dimension or the largest dimension of the baffle element in a plane normal to the tube axis is 0.2–0.9 times the internal diameter of the tube;

e. there are apertures in the tube wall which are located in the tube wall so as to be at least in part opposite said baffle element;

f. radial walls are disposed between the baffle and the tube in positions such as to prevent air entering the tube through one aperture from flowing directly out of the tube via another aperture.

According to a preferred feature, the baffle element has a streamlined elevational profile. For example such profile may have the form of an inverted triangle, a semi-circle, a semi-ellipse, a parabola, a hyperbola, or an intermediate of these figures. The stream-lining is of course with respect to the gas flow from the gas-fired appliance. The bottom of the baffle element, i.e. its upstream end, is preferably at or near the level of the smallest flow path cross-section defined by the annular combustion gas deflector.

The axial dimension of the baffle element is preferably 0.25 to 1 times the internal diameter of the tube.

As an alternative to a baffle element of axially stream-lined form, a baffle element may be used which is in the form of a flat plate, e.g. circular plate, disposed in a plane normal to the tube axis. Such plate may, e.g., be located so that the axial distance between the plate and the aforesaid level of smallest flow path cross-section defined by the combustion gas deflector is from 0.2–1 times the internal tube diameter.

The number of radial walls provided in a down-draught deflector according to the invention may for example be an even multiple of the number of said apertures in the tube wall.

Certain embodiments of the invention, selected by way of example, will now be described with reference to the accompanying diagrammatic drawings, in which.

Figure 1:
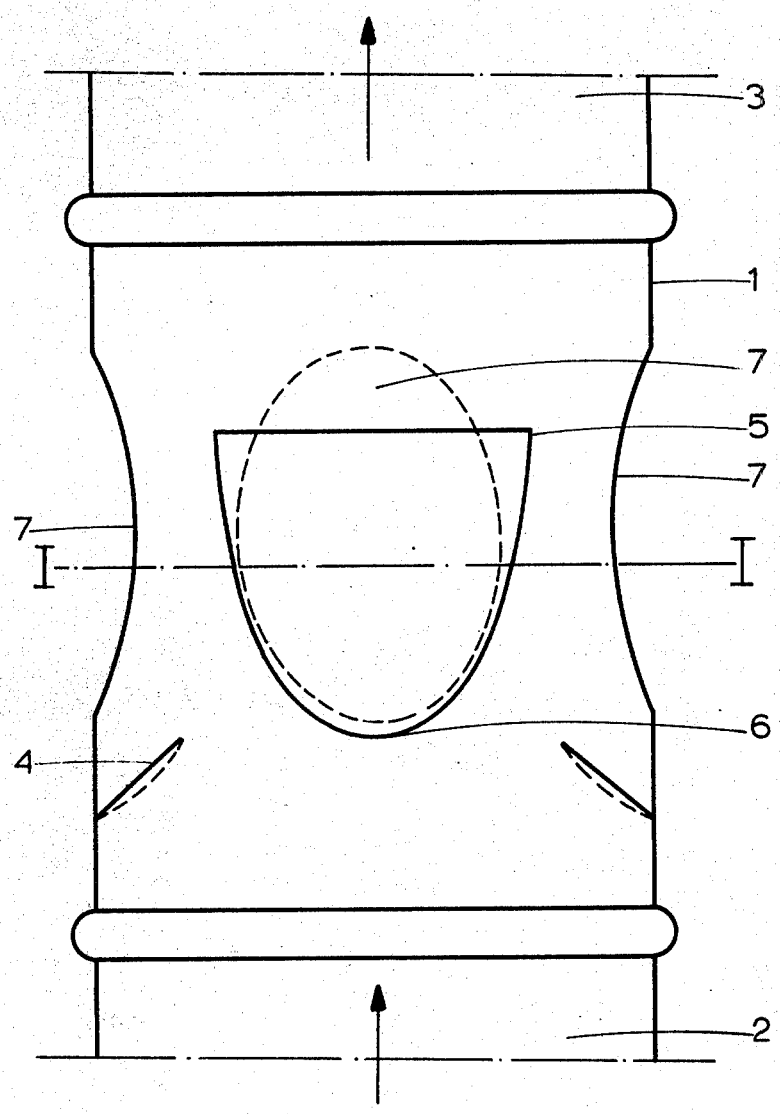
FIG. 1 shows a down-draught deflector in cross-sectional elevation; but with certain parts omitted.
Figure 2:
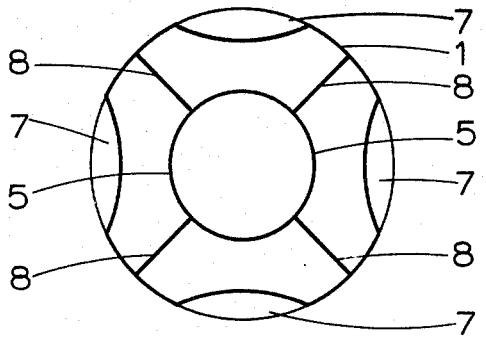
FIG. 2 is a cross-section on line I—I of FIG. 1.

The down-draught deflector according to FIGS. 1 and 2 comprises a tube 1 which is mounted between sections 2 and 3 of the flue pipe of a gas-fired appliance e.g., a central-heating boiler. The combustion gases from the appliance flow in the direction indicated by the arrows. Ambient air is aspirated into the tube 1 by natural draught effect, through peripheral apertures 7 in the tube wall, and becomes mixed with the combustion gases in the flue pipe. There are four such peripheral apertures 7 symmetrically spaced around the tube axis.

Within the lower end portion of the tube 1 there is a ring 4 serving as a combustion gas deflector. The ring deflects the combustion gases from the gas-fired appliance inwardly towards the tube axis. The ring may for example have a flat profile and thus conform to the surface of a cone, or as another example, the ring may have a curved profile as indicated in broken line.

Within the tube 1 there is a baffle element 5 which is this particular embodiment is of approximately semi-ellipsoidal form. This baffle is disposed with its axis coincident with the tube axis, substantially opposite the apertures 7, the bottom or upstream end 6 of the baffle element being approximately at the level of the smallest flow path cross-section defined by the ring 4. The apertures 7 extend a certain distance downstream beyond the baffle element 5. The baffle element is supported in the position described by radial walls 8 which have been omitted from FIG. 1 but are shown in FIG. 2.

In operation, combustion gases from the gas-fired appliance are deflected inwardly towards the tube axis by the ring 4 so that they are caused to flow upwardly along the surface of the baffle element 5 and do not escape through the apertures 7. Ambient air is drawn into the tube through those apertures and becomes mixed with the combustion gases as they leave the said tube and flow along the pipe section 3. In the event of a down-draught, the down-draught gases are caused by the baffle element 5 to flow radially outwardly so that they escape through the apertures 7.

When an ambient air stream having for example a velocity of 1 meter/second or higher enters any of the apertures 7 horizontally or with a horizontal component of motion, the walls 8 disposed between that aperture and the neighbouring apertures prevent such air stream from carrying or forcing combustion gases out of the tube 1 through one such neighbouring apertures, and constrain such entering ambient air stream to flow upwardly past the baffle element 5 with the combustion gases.

Numerous modifications of the design shown in FIGS. 1 and 2 are possible. For example, there may be fewer or more apertures 7 and/or they may be of different shape and/or dimensions, and/or they may be differently arranged. The apertures may extend considerably further beyond the baffle element 5 in the downstream direction, but preferably not by more than three times the internal diameter of the tube. The apertures do not in any case extend beyond the ring 4 in the upstream direction.

Figure 3:
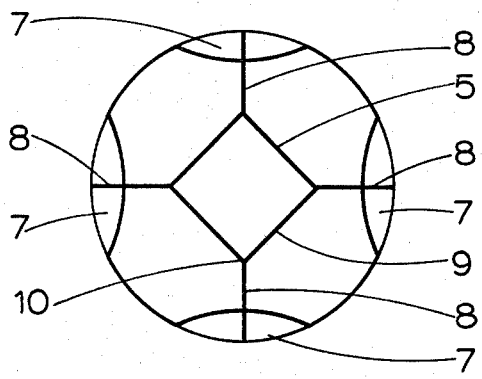
FIG. 3 is a cross-section, similar to FIG. 2, of a second embodiment of the invention.
Figure 4:
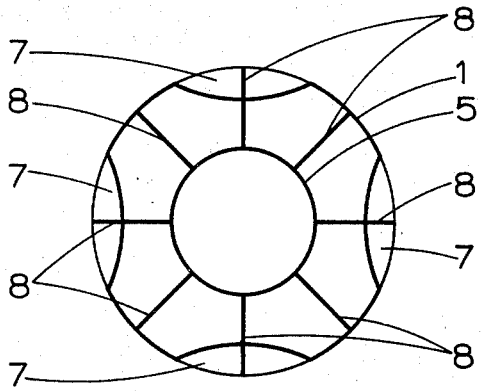
FIG. 4 is a cross-section, similar to FIG. 2, of a third embodiment of the invention.

The down-draught deflectors shown in FIGS. 3 and 4 have differently arranged baffle-supporting walls 8 and the deflector shown in FIG. 3 has a baffle element which is square in plan aspect. In FIG. 3 the walls 8 bisect the apertures 7 longitudinally. In FIG. 4 there are four baffle-supporting walls 8 bisecting the apertures 7 and four further such walls separating the different apertures from each other. The mentioned dimension parameters of the down-draught deflector are given within wide ranges. It has been shown by experiment that the dimensions can be varied within the given wide ranges, without a less better functioning of the down-draught deflector. The axial extent of the baffle supporting walls or fins 8 is dependent of the apertures 7. If the apertures 7 are arranged to extend considerably above the baffle element than it is necessary that the fins have a similar axial extent.

Figure 5:
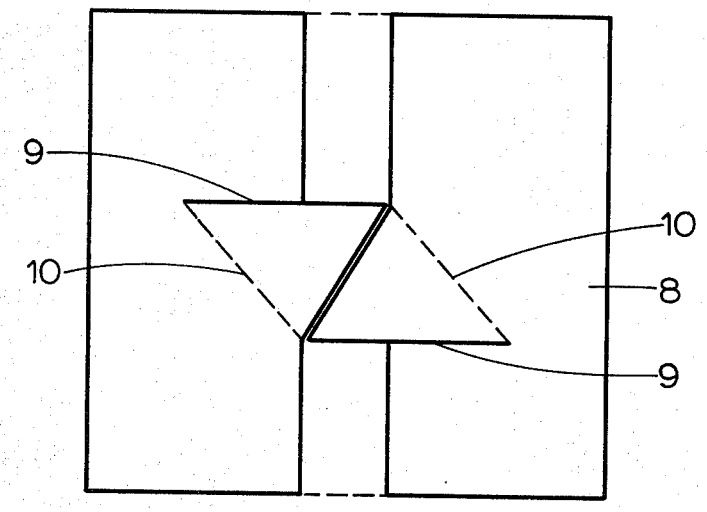
FIG. 5 is a detail of a possible design down-draught deflector according the invention.

How to obtain in a simple and cheap way a baffle element with square cross-section combined with fins is shown in FIG. 5. A sheet of plate-iron is cut through over the solid lines, after which the sheet is bent over the dotted lines 10. By joining a double pair of such cutted sheets the baffle element with fins will be formed.

What is claimed is:

1. A down-draught deflector for use in the flue of a gas-fired appliance comprising a tube of circular cross-section having an internal baffle element for laterally deflecting down-draught gases and at least two peripheral escape apertures for such gases, said deflector including, in combination:

a. said tube having a substantially constant external diameter;

b. an annular combustion gas deflector located in an upstream end portion of said tube for deflecting combustion gases inwardly toward the tube axis, said combustion gas deflector defining a gas flow path which at the position of its smallest cross-section has a diameter of 0.3–0.9 times the internal diameter of the tube;

c. said baffle element occupying within the tube a position at least partly downstream with respect to said position of smallest flow path cross-section and having a profile which is substantially streamlined with respect to gas flow through the tube from said upstream end portion thereof;

d. the largest dimension of said baffle element in a plane normal to the tube axis being between 0.2–0.9 times the internal diameter of the tube;

e. said apertures being provided in the tube wall with said apertures being located in the tube wall so as to be at least in part horizontally opposite said baffle element;

f. radial walls being disposed between the baffle and said tube in positions such as to prevent air entering the tube through one aperture from flowing directly out of the tube via another of said apertures.

2. A down-draught deflector according to claim 1, characterized in that the number of said radial walls is an even multiple of the number of said apertures.

3. A down-draught deflector according to claim 1, characterized in that in side elevation said baffle element has a profile approximately conforming to a triangle.

4. A down-draught deflector according to claim 1, characterized in that the upstream end of the baffle element is located at or near the said position of smallest cross-section of the flow path defined by said combustion gas deflector.

5. A down-draught deflector according to claim 4, characterized in that the said baffle element has a length of 0.25–1 times the internal diameter of the tube.

6. A down-draught deflector according to claim 1, characterised in that the apertures do not extend beyond the baffle element in the downstream direction by more than three times the internal diameter of the tube.

7. A down-draught deflector according to claim 1, characterized in that in side elevation said baffle element has a profile approximately conforming to a semicircle.

8. A down-draught deflector according to claim 1, characterized in that in side elevation said baffle element has a profile approximately conforming to a semi-ellipse.

9. A down-draught deflector according to claim 1, characterized in that in side elevation said baffle element has a profile approximately conforming to a parabola.

10. A down-draught deflector according to claim 1, characterized in that in side elevation said baffle element has a profile approximately conforming to a hyperbola.

11. A down-draught deflector for use in the flue of a gas-fired appliance comprising a tube of circular cross-section having an internal baffle element for laterally deflecting down-draught gases and at least two peripheral escape apertures for such gases, said deflector including, in combination:

a. said tube having a substantially constant external diameter;

b. an annular combustion gas deflector disposed in the upstream end portion of said tube for deflecting combustion gases inwardly toward the axis of said tube, said combustion gas deflector defining a gas flow path which at the position of its smallest cross-section has a diameter of between 0.3–0.9 times the internal diameter of said tube;

c. said baffle element occupying within the tube a position at least partly downstream with respect to said position of smallest flow path cross-section and having the form of a flat plate disposed downstream from the said position of smallest cross-section by a distance of 0.2–1 times the internal tube diameter;

d. the largest dimension of said baffle element in a plane normal to the tube axis being between 0.2–0.9 times the internal diameter of the tube;

e. said tube wall having said apertures located therein so as to be at least in part horizontally opposite said baffle element;

f. said tube having radial walls disposed between the baffle and said tube in positions such as to prevent air entering the tube through one aperture from flowing directly out of the tube via another of said apertures.

* * * * *